US012741721B2

(12) United States Patent
Iwata

(10) Patent No.: US 12,741,721 B2
(45) Date of Patent: Sep. 22, 2026

(54) PERSONAL WATERCRAFT

(71) Applicant: KAWASAKI MOTORS, LTD., Hyogo (JP)

(72) Inventor: Tetsuya Iwata, Akashi (JP)

(73) Assignee: KAWASAKI MOTORS, LTD., Hyogo (JP)

( * ) Notice: Subject to any disclaimer, the term of this patent is extended or adjusted under 35 U.S.C. 154(b) by 529 days.

(21) Appl. No.: 18/209,480

(22) Filed: Jun. 14, 2023

(65) Prior Publication Data

US 2024/0417041 A1 Dec. 19, 2024

(51) Int. Cl.
*B63B 34/10* (2020.01)
*B63B 49/00* (2006.01)

(52) U.S. Cl.
CPC ..... *B63B 34/10* (2020.02); *B63B 49/00* (2013.01); *B63B 2201/18* (2013.01)

(58) Field of Classification Search
CPC ..... B63B 34/00; B63B 34/10; B63B 49/00; B63B 2201/18
USPC ..... 114/55.5
See application file for complete search history.

(56) References Cited

U.S. PATENT DOCUMENTS

| | | | | |
|---|---|---|---|---|
| 10,494,074 | B1 * | 12/2019 | Duquette | B63H 11/04 |
| 2021/0255627 | A1 | 8/2021 | Snyder et al. | |
| 2023/0012090 | A1 * | 1/2023 | Tsubone | G01S 15/93 |
| 2023/0029055 | A1 * | 1/2023 | Tsubone | G01C 21/203 |

* cited by examiner

*Primary Examiner* — Daniel V Venne
(74) *Attorney, Agent, or Firm* — XSENSUS LLP

(57) ABSTRACT

A personal watercraft includes a watercraft body having a watercraft bottom, a propulsion device, and a sonar. The propulsion device includes an engine supported by the watercraft body and a jet pump arranged rearward the engine and driven by the engine. The sonar is arranged at the watercraft bottom forward relative to the engine, and capable of transmitting and receiving sound waves.

18 Claims, 11 Drawing Sheets

PERSONAL WATERCRAFT

BACKGROUND

Technical Field

The present disclosure relates to a personal watercraft.

Background Art

US 2021/0,255,627 A discloses a personal watercraft mounted with a sonar that detects an object below the watercraft body by transmitting and receiving sound waves for fish-finding and shoal detection. The personal watercraft is mounted with an engine and a jet pump. Vibration of the engine, a water flow generated by the jet pump, bubbles, and the like may deteriorate detection accuracy of the sonar.

SUMMARY

An object of the present disclosure is to improve detection accuracy of an underwater object by a sonar in a personal watercraft mounted with the sonar.

A personal watercraft according to one aspect of the present disclosure includes: a watercraft body having a watercraft bottom; a propulsion device including an engine supported by the watercraft body and a jet pump arranged rearward the engine and driven by the engine; and a sonar arranged on the watercraft bottom forward relative to the engine and capable of transmitting and receiving sound waves.

A personal watercraft according to another aspect of the present disclosure includes: a watercraft body having a watercraft bottom; an impeller that discharges, from a discharge port, water sucked from a water suction port formed in the watercraft bottom; and a sonar arranged on the watercraft bottom relative to the water suction port and capable of transmitting and receiving sound waves.

DETAILED DESCRIPTION

Embodiments of a personal watercraft 1 according to the present disclosure will be described below with reference to the drawings. Some drawings are given direction indication of front, rear, left, and right, and these directions match directions viewed from an operator on the personal watercraft 1. In the embodiments described below, an example will be described in which the personal watercraft 1 is a jet propulsion type personal watercraft that navigates on water in reaction to water flow jetted rearward.

[Overall Structure of Personal Watercraft]

Figure 1:
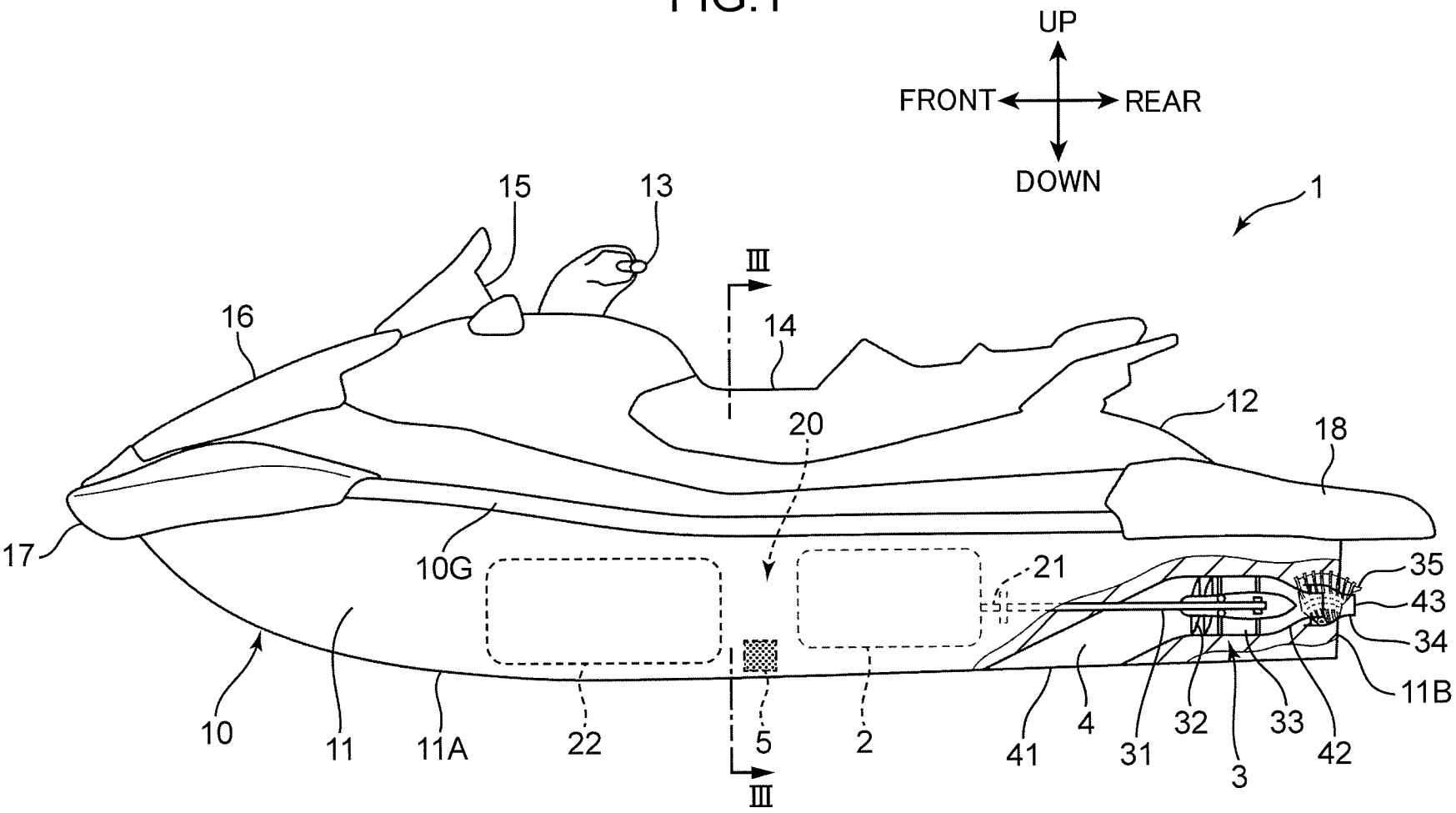
FIG. 1 is a partially broken side view of a personal watercraft according to an embodiment of the present disclosure.
Figure 2:
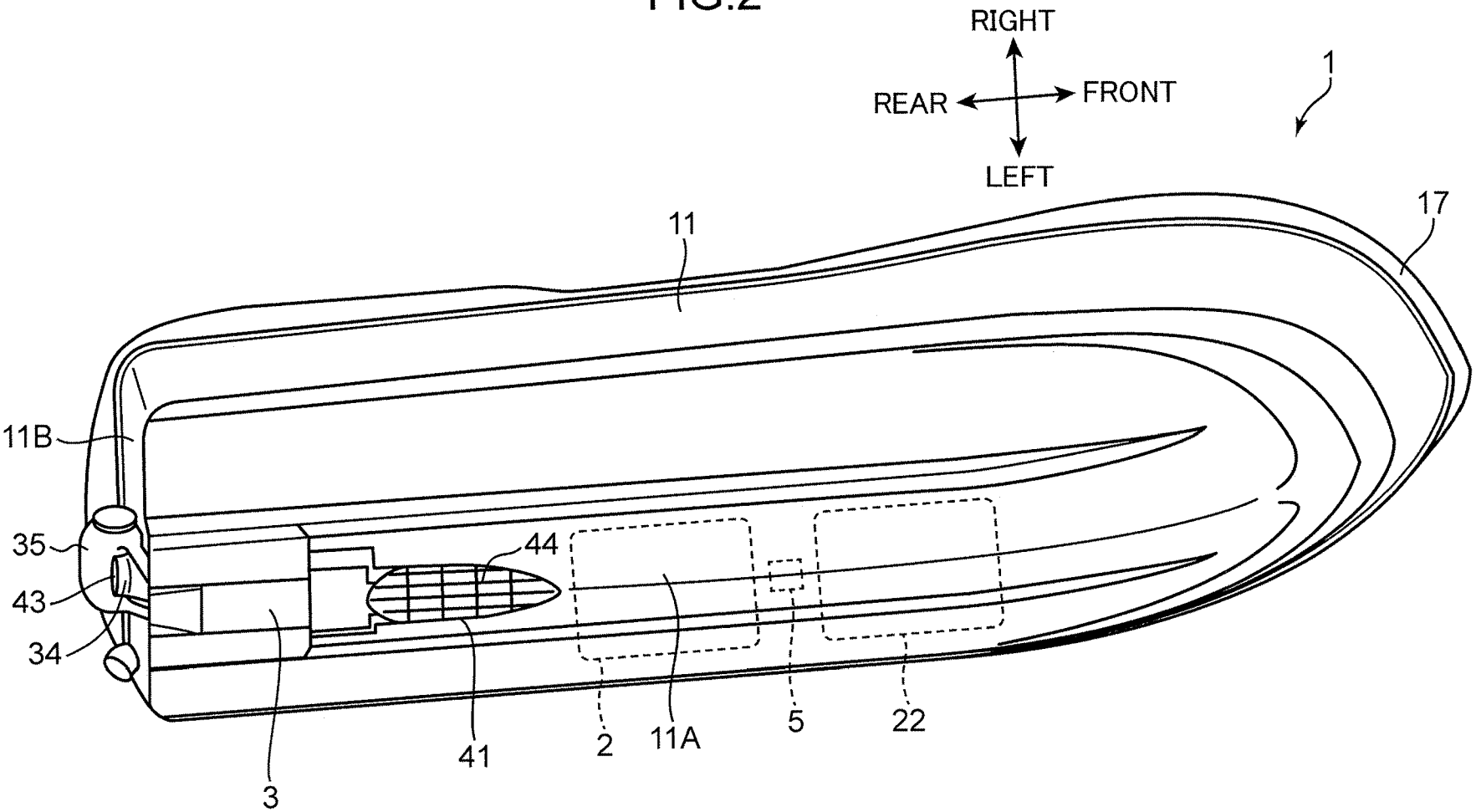
FIG. 2 is a perspective view of the personal watercraft as viewed from the watercraft bottom side.

FIG. 1 is a partially broken side view of the personal watercraft 1, and FIG. 2 is a perspective view of the personal watercraft as viewed from the watercraft bottom side. The personal watercraft (PWC) 1 is a straddle-type jet propulsion watercraft that jets a water flow rearward and navigates in reaction to the water flow. The personal watercraft 1 includes a watercraft body 10, an engine 2, a jet pump 3, and an impeller passage 4 as propulsion devices of the watercraft body 10, and a sonar 5 arranged on a watercraft bottom 11A of the watercraft body 10.

The watercraft body 10 includes a hull 11 and a deck 12 covering the upper surface of the hull 11, and is propelled with a jet water flow. The hull 11 and the deck 12 are connected to each other over the entire circumference by a gunwale line 10G. A lower surface of the hull 11 is the watercraft bottom 11A. The deck 12 is provided with a handle 13, an operator seat 14, and a display panel 15. The handle 13 includes a throttle lever and is operated by the operator for steering the personal watercraft 1. The operator seat 14 is arranged at a substantially center position in front and rear as well as left and right of the deck 12, and is a seat where the operator and a passenger straddle. The present embodiment exemplifies the operator seat 14 for three persons including the operator. The display panel 15 is arranged forward the handle 13 and displays various types of information related to the navigation of the personal watercraft 1, such as a navigation speed, a remaining amount of fuel, and an operation mode.

The deck 12 further includes a front hatch 16, a front bumper 17 and a boarding platform 18. The front hatch 16 covers an upper surface opening of a luggage room provided forward the display panel 15. The front bumper 17 covers the foremost part of the watercraft body 10. The boarding platform 18 is arranged rearward the operator seat 14 so as to cover the hull 11 and is used mainly when the operator or the passenger straddles the operator seat 14 from under water.

The engine 2 is accommodated in and supported by an engine room 20 provided inside the hull 11. The engine 2 is, for example, a water-cooled four-stroke multicylinder engine using gasoline as fuel, and generates a driving force for driving the jet pump 3. The engine 2 includes a crankshaft 21 extending in the front-rear direction. A fuel tank 22 is arranged forward the engine 2 at a predetermined interval. The fuel tank 22 stores fuel to be supplied to the engine 2, and is installed on the watercraft bottom 11A.

In order to give the personal watercraft 1 a propulsive force, the jet pump 3 pressurizes and accelerates the water taken into the impeller passage 4 and injects the water rearward. The jet pump 3 is arranged rearward the engine 2. The jet pump 3 includes a pump shaft 31, an impeller 32, a pump case 33, a jet nozzle 34, and a reverse gate 35. The rear end of the pump shaft 31 is attached with the impeller 32, and the front end is coupled to the rear end of the crankshaft 21.

The impeller 32 generates a jet water flow by rotating about an axis. The driving force of the engine 2 is transmitted to the impeller 32 via the crankshaft 21 and the pump shaft 31. The pump case 33 is arranged rearward the impeller 32 and rotatably supports the rear end side of the pump shaft 31.

The jet nozzle 34 is arranged rearward the pump case 33 and has an outlet port 43 for jetting the jet water flow generated by the impeller 32. The jet nozzle 34 has a tapered shape in which the passing water cross-sectional area decreases toward the rear. The jet nozzle 34 is pivotable about an axis extending in the up-down direction, and the jet direction of the jet water flow from the outlet port 43, that is, the propulsion direction of the personal watercraft 1 is changed left and right by the steering of the handle 13. The reverse gate 35 is attached to the jet nozzle 34 pivotably about an axis extending in the left-right direction. When the reverse gate 35 descends so as to cover the outlet port 43, the propulsion direction of the personal watercraft 1 is changed rearward.

The impeller passage 4 is provided in a rear region of the hull 11, and the impeller 32 is arranged in the impeller passage 4. The impeller passage 4 includes a water intake 41 formed on the watercraft bottom 11A of the hull 11 as a water suction port. The discharge port of the impeller passage 4 is the outlet port 43 described above. The impeller passage 4 is a water passage for pressurizing, by the impeller 32, water sucked from the water intake 41 and injecting the water from the outlet port 43. The vicinity of the rear end of the impeller passage 4 is a tapered part 42 whose passing water cross-sectional area is gradually narrowed, and enters the front end of the jet nozzle 34.

The sonar 5 is a device that detects an object by transmitting and receiving sound waves. In the present embodiment, the sonar 5 is arranged on the inner surface of the watercraft bottom 11A, and is arranged to detect an object underwater or the water bottom below the watercraft body 10. The sound wave emitted from the sonar 5 propagates underwater and is reflected by an object existing underwater. The reflected sound wave is received by the sonar 5. By analyzing the received sound wave, it is possible to estimate the position, the configuration, the shape, and the like of the object. Specific examples of the sonar 5 can include a searchlight sonar that can transmit and receive ultrasonic waves while rotating a transmission direction of an ultrasonic beam emitted from an ultrasonic sensor probe, and can detect underwater information such as a fish school, a shoal, and an obstacle existing underwater at 360 degrees around the watercraft body 10. In addition to this, it is possible to use a scanning sonar, a sector scanning sonar, or the like that detects undersea information by emitting ultrasonic waves in all directions or a certain angular range of the watercraft body 10.

According to the personal watercraft 1 equipped with the sonar 5, for example, the following operation becomes possible.

- To provide a user on the personal watercraft 1 enjoying fishing with fishing spot information where fishing exploits can be easily achieved based on an underwater fish school detected by the sonar 5.
- To provide a user with underwater information such as a shoal and an obstacle detected by the sonar 5 to prevent the personal watercraft 1 from colliding with the shoal and the obstacle, and suppress gravel of the bottom of water and water weeds from being sucked from the water intake 41 when sailing on the shoal.

[Arrangement Position of Sonar]

As illustrated in FIGS. 1 and 2, the arrangement position of the sonar 5 generally on the watercraft bottom 11A in the vicinity of the center in the front-rear direction and the left-right direction of the watercraft body 10. As described in detail later, the watercraft bottom 11A is not provided with an opening for exposing a probe surface of the sonar 5, and the sonar 5 is attached on the inner surface of the watercraft bottom 11A. The sonar 5 is arranged on the watercraft bottom 11A forward the engine 2 in relation to the engine 2. More specifically, the sonar 5 is arranged between the fuel tank 22 and the engine 2.

An ultrasonic vibrator is arranged on the probe surface of the sonar 5. The vibrator ultrasonically vibrates by being given an electric signal to vibrate the probe surface. Conversely, the vibrator outputs an electric signal when vibration is applied. The ultrasonic vibration generated on the probe surface by giving an electric signal to the vibrator vibrates the watercraft bottom 11A facing the probe surface, and generates an ultrasonic wave toward underwater. On the other hand, when the reflected wave of the ultrasonic wave vibrates the watercraft bottom 11A, the vibration is transmitted from the watercraft bottom 11A to the probe surface. An image of an underwater object is formed by analyzing an electrical signal generated by the vibrator due to vibration of the probe surface. Note that if a filler filling a gap is filled between the probe surface and the watercraft bottom 11A, vibration transmission between the probe surface and the watercraft bottom 11A can be enhanced.

Vibration of the engine and the impeller 32, a jet water flow created by the impeller 32 and its vibration, bubbles contained in the water flow, and the like may deteriorate detection accuracy of the sonar 5. That is, the vibration and the bubbles affect the progress of the ultrasonic wave transmitted from the sonar 5 and the ultrasonic wave reflected from the object, and the accuracy of the object detection based on transmission and reception of ultrasonic waves may be impaired.

The personal watercraft 1 is propelled by a jet water flow ejected from the outlet port 43 on a rear end surface 11B of the watercraft body 10. The impeller passage 4 in which the impeller 32 is disposed is arranged in the vicinity of the rear end of the watercraft body 10. The engine 2 that rotationally drives the impeller 32 is arranged forward the impeller passage 4. The sonar 5 is positioned forward relative to the engine 2. The sonar 5 is separated from the support part of the pump shaft 31 and the jet pump 3, so that the sonar 5 can become hardly affected by the vibration. By separating the sonar 5 from the impeller passage 4, it is possible to make it difficult for the sonar 5 to be affected by vibration due to the water flow flowing through the impeller passage 4. As described above, by suppressing the influence of vibration on the sonar 5, it is possible to improve the detection accuracy of the sonar 5.

By arranging the sonar 5 between the fuel tank 22 and the engine 2, it is possible to effectively use a space in the watercraft body 10. In the present embodiment, the engine 2 having a high temperature during operation and the fuel tank 22 accommodating a combustible fuel are arranged at a certain interval. In the present embodiment, the sonar 5 is arranged in an empty space generated between the engine 2 and the fuel tank 22, and thus the empty space is effectively used.

The arrangement of the sonar 5 is also considered in relation to the impeller passage 4. The sonar 5 is arranged on the watercraft bottom 11A forward relative to the water intake 41, which is a water suction port. Due to the operation of the impeller 32, vibration and bubbles based on intense water flow are generated in the outlet port 43, which is a discharge port of the jet water flow, and the water intake 41. In the present embodiment, as illustrated in FIG. 1, the engine 2 is installed forward the water intake 41 at the front end of the impeller passage 4. The sonar 5 is attached further forward the engine 2. That is, the sonar 5 and the impeller passage 4 are sufficiently separated from each other across the engine. Due to this, the sound wave propagating through the water for detecting the underwater object can be hardly affected by the water flow generated by the jet pump 3 and the bubbles contained in the water flow. Therefore, the detection accuracy of the sonar 5 can be improved.

The arrangement of the engine 2 on the watercraft body 10 will also be described. With reference to FIGS. 1 and 2, the engine 2 is arranged at the center in the left-right direction of the watercraft body 10 slightly rearward in the front-rear direction of the watercraft body 10. The crankshaft 21 extends along the center axis in the front-rear direction of the watercraft body 10. The engine 2 is arranged forward relative to the water intake 41 and rearward relative to the handle 13. Although the engine 2 is arranged below the operator seat 14, the engine 2 is positioned rearward relative to the front end of the operator seat 14 and forward relative to the rear end. The fuel tank 22 is arranged forward relative to the engine 2 at an interval in the front-rear direction with respect to the engine 2. The fuel tank 22 is positioned substantially below the handle 13.

[Attachment Aspect of Sonar to Watercraft Bottom]

Figure 3:
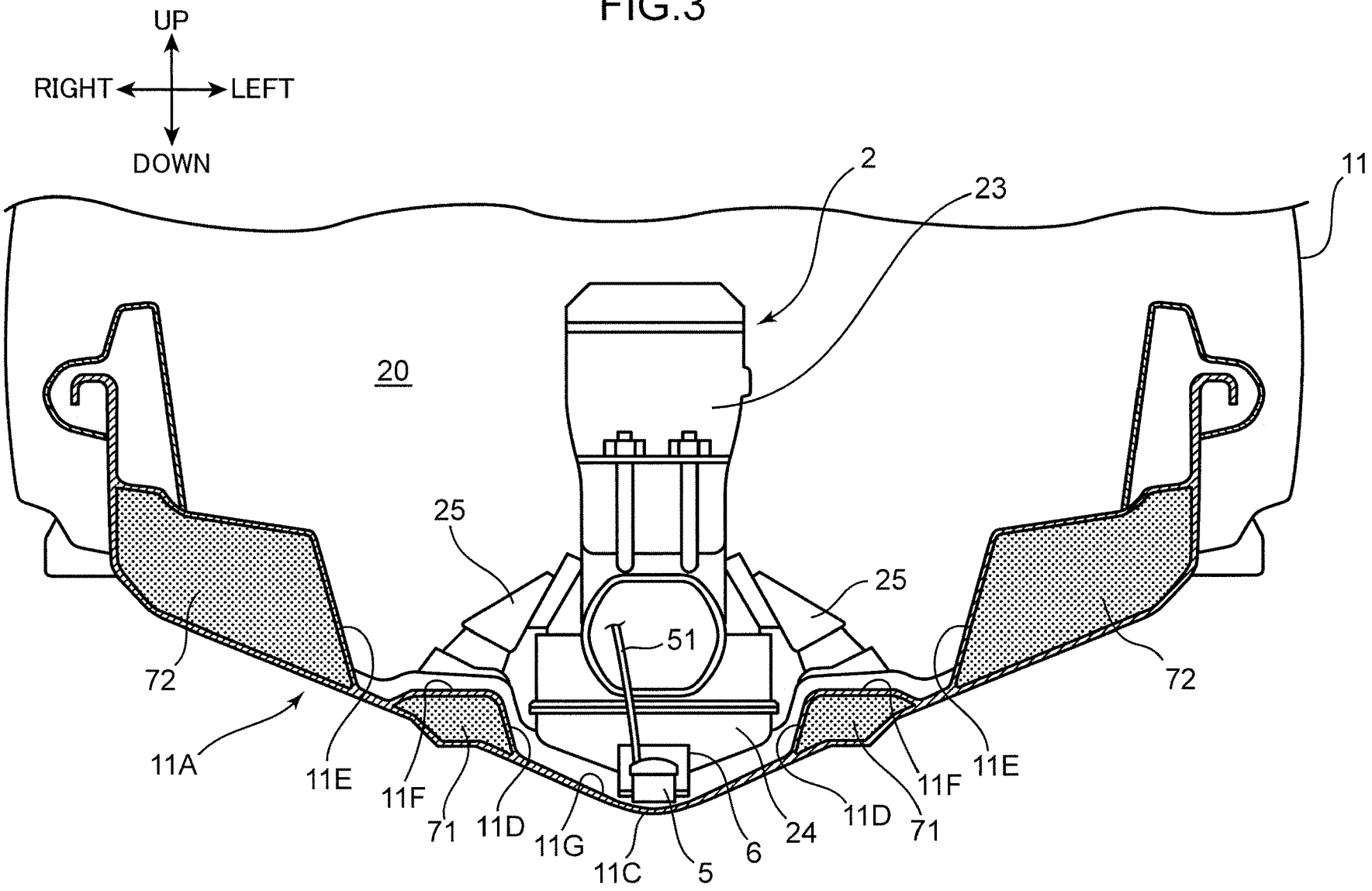
FIG. 3 is a cross-sectional view taken along line III-III of FIG. 1.
Figure 4:
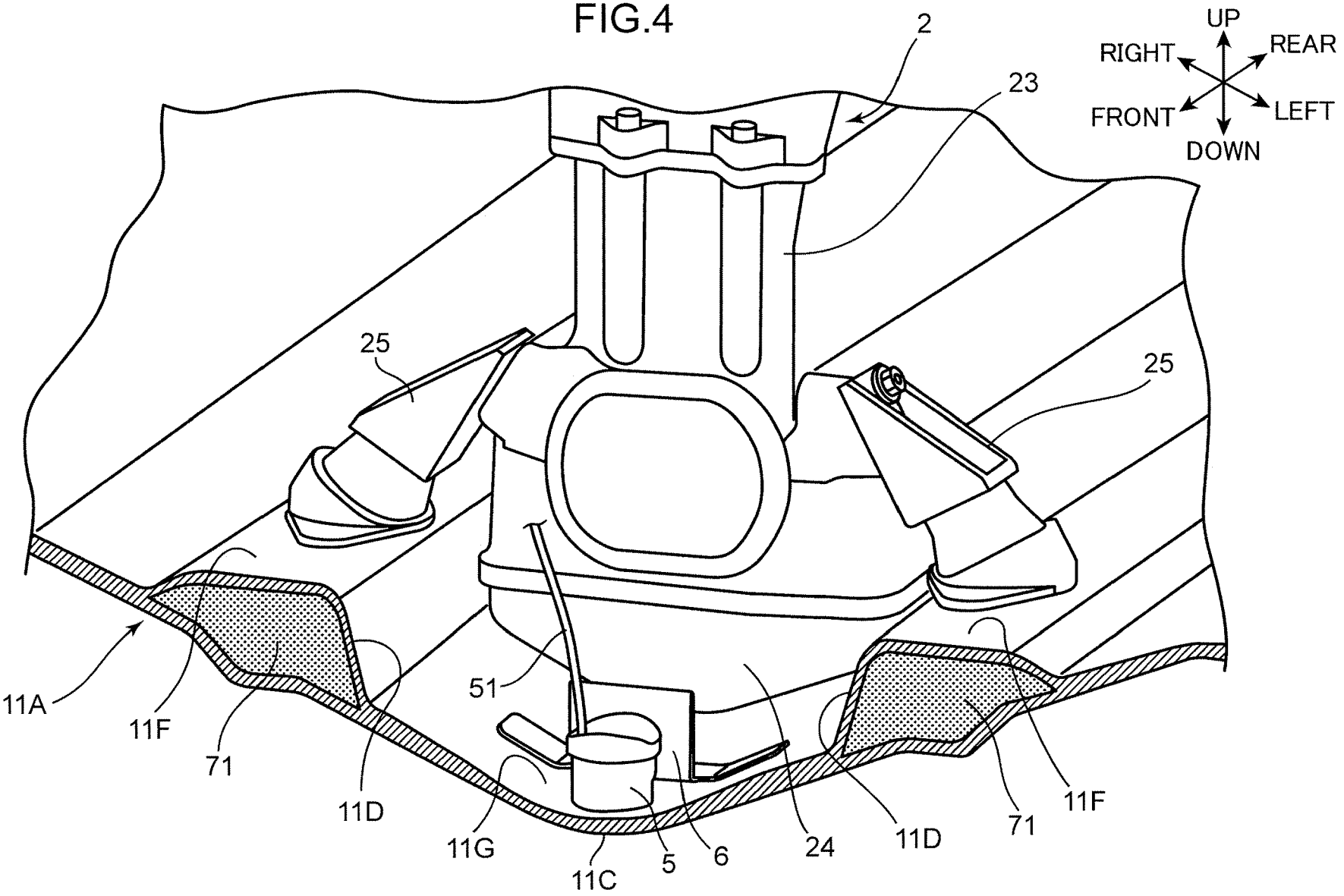
FIG. 4 is a perspective view of the cross section illustrated in FIG. 3 as viewed from an oblique direction.

An attachment aspect of the sonar 5 to the watercraft bottom 11A will be described in detail with reference to FIGS. 3 and 4 in addition to FIG. 1. FIG. 3 is a cross-sectional view taken along line III-III of FIG. 1, and FIG. 4 is a perspective view of the cross section illustrated in FIG. 3 as viewed from an oblique direction. First, the internal structure of the watercraft body 10 will be described. The watercraft bottom 11A, which is a bottom wall of the hull 11, has a curved surface shape convex downward in a cross section orthogonal to the center axis in the front-rear direction of the watercraft body 10 that is illustrated in FIG. 3. That is, the left-right direction center part of the watercraft bottom 11A is a deepest part 11C protruding most downward in a convex curved surface of the watercraft bottom 11A. The curved surface of the deepest part 11C is an inflection curved surface that changes from a downward gradient to an upward gradient in the left-right direction, but is a relatively gentle curved surface close to a flat surface.

The watercraft bottom 11A includes a pair of first closed cross section parts 11D and a pair of second closed cross section parts 11E extending in the front-rear direction. The first closed cross section part 11D is arranged across the center axis in the front-rear direction of the watercraft body 10, in other words, as a pair of left and right across the deepest part 11C, and includes a wall defining a space having a substantially parallelogram cross section on the watercraft bottom 11A. The second closed cross section part 11E is arranged as a pair of left and right across the pair of first closed cross section parts 11D, and similarly each includes a wall defining a space having a substantially parallelogram cross section on the watercraft bottom 11A. The second closed cross section part 11E has a closed cross section larger than that of the first closed cross section part 11D, and is arranged in the vicinity of the left and right side walls of the hull 11.

The watercraft bottom 11A can be formed of, for example, a laminate of fiber reinforced plastic (FRP) sheets. The first closed cross section part 11D and the second closed cross section part 11E are formed by sandwiching a core matching the respective closed cross section part sizes at the time of laminating the FRP sheets. In the present embodiment, an example in which two pairs of closed cross section parts 11D and 11E are provided is presented, but only one pair of closed cross section parts may be provided across the deepest part 11C.

In order to give buoyancy to the watercraft body even if the watercraft body 10 overturns, a first foam member 71 is accommodated in the closed space of the first closed cross section part 11D, and a second foam member 72 is accommodated in the closed space of the second closed cross section part 11E. The first foam member 71 and the second foam member 72 are, for example, foamable plastic and are members having a lower density than water. Even if water enters the watercraft body, it is possible to maintain a region where water does not enter by the equipping of the foam members 71 and 72, and it is possible to provide residual buoyancy when the watercraft body 10 overturns. The first foam member 71 and the second foam member 72 are considered "buoyant foam" or "buoyant foam structures."

The upper surfaces of the pair of first closed cross section parts 11D are flat surfaces, and in the present embodiment, the upper surface of the first closed cross section part 11D is used as amount surface 11F of the engine 2. The engine 2 includes an engine body 23 arranged above the deepest part 11C and having a cylinder, and an oil pan 24 equipped to a lower part of the engine body 23. The engine 2 is supported by a pair of engine support tools 25 on both left and right side surfaces of the engine body 23. The engine support tool 25 is a support tool including a damper that exhibits an anti-vibration function, and has a lower end fixed to the mount surface 11F and an upper end engaged with a left or right side surface of the engine body 23. The engine 2 is supported by the engine support tool 25 in an aspect that the oil pan 24 enters between the pair of first closed cross section parts 11D but floats from the watercraft bottom 11A.

The sonar 5 is arranged on a sonar installation surface 11G, which is the inner surface of the deepest part 11C in the convex curved surface of the watercraft body 10. The sonar installation surface 11G is a surface constituting a part of the inner surface of the watercraft bottom 11A, and is not particularly provided with an opening or a recess for installing the sonar 5. As mentioned earlier, the deepest part 11C is positioned at the left-right direction center part of the watercraft bottom 11A. Therefore, it can also be said that the sonar 5 is arranged at the left-right direction center part of the watercraft bottom 11A. The sonar installation surface 11G is positioned forward relative to the front side surface of the engine 2 and away forward relative to the support position of the engine 2 by the engine support tool 25. FIGS. 3 and 4 illustrate a part of a cable 51 extending from the body of the sonar 5.

The sonar 5 is arranged at the deepest part 11C of the watercraft bottom 11A, in other words, at the left-right direction center part of the watercraft bottom 11A. Due to this, the probe surface at the lower end serving as a sound wave transmission and reception surface in the sonar 5 can be easily positioned below the water surface at all times during standstill and planing. That is, it is easy to position the probe surface of the sonar 5 at all times lower than the draft line, which is an intersection line between the watercraft body 10 and the water surface. For example, even when the personal watercraft 1 is tilted at the time of turning, the deepest part 11C or the left-right direction center part of the watercraft bottom 11A is often positioned lower than the draft line. Therefore, a detection error of the sonar 5 can be suppressed. Note that the sonar 5 may be arranged at the deepest position of the watercraft bottom 11A in a strict sense or at the left-right direction center position of the watercraft bottom 11A, or may be arranged at a position slightly shifted in the left-right direction from these positions.

In the present embodiment, the sonar 5 is arranged at a position rearward away from the front end of the watercraft body 10. For this reason, even in a planing state where the bow of the personal watercraft 1 floats on the water surface, the sonar 5 can be easily positioned lower than the water surface. As in the present embodiment, the sonar 5 is arranged rearward relative to the handle 13, rearward relative to the fuel tank 22, and rearward relative to the front end of the operator seat 14, whereby it is possible to prevent exposure of the sonar 5 on the water in the above-described planing state.

Unlike the present embodiment, when the sonar 5 is arranged on the inclined surface of the watercraft bottom 11A considerably away to the left or right from the deepest part 11C, it is necessary to attach an adaptor holding a filler filling between the probe surface of the sonar 5 and the inclined surface that are arranged horizontally. However, in the present embodiment, since the sonar 5 is installed on the substantially flat sonar installation surface 11G, it is not necessary to attach the adapter.

In order to easily attach the sonar 5 with an adhesive or the like without using the adapter as described above, the sonar installation surface 11G is desirably a flat surface with a small inclination as much as possible. Specifically, in the watercraft bottom 11A, a flat surface having a radius of curvature of 50 meters or more, preferably 100 meters or more is preferably the sonar installation surface 11G. In the cross section orthogonal to the center axis in the front-rear direction of the watercraft body 10, the sonar installation surface 11G is desirably a quasi-horizontal plane having an inclination angle of 10 degrees or less, preferably 6 degrees or less, with respect to the horizontal plane in a horizontal state where the watercraft body 10 is not inclined in the left-right direction. The convex curved surface of the deepest part 11C may be a partial flat surface, and the sonar installation surface 11G may have an inclination of substantially 0 degrees with respect to the horizontal plane in the horizontal state.

If the sonar installation surface 11G has the radius of curvature and the inclination angle as described above, the sonar 5 can be arranged on a flat and nearly horizontal surface of the inner surface of the watercraft bottom 11A. Therefore, installation work of the sonar 5 onto the watercraft bottom 11A becomes easy. Since transmission and reception of sound waves can be performed on a flat and nearly horizontal surface, there is an advantage that detection accuracy of the sonar 5 is easily secured.

The sonar 5 is arranged in a region of the watercraft bottom 11A excluding the arrangement positions of the foam member 71 and the foam member 72. As mentioned earlier, in order to apply residual buoyancy to the watercraft body 10, the watercraft bottom 11A is provided with the two closed cross section parts 11D and 11E, and the foam members 71 and 72 are accommodated in the respective parts. In the present embodiment, the sonar 5 is arranged except for the arrangement positions of the foam members 71 and 72. Due to this, the sonar can prevent the influence of the air in the air bubbles contained in the foam members 71 and 72, and the detection accuracy can be improved as compared with the case where the sonar is arranged on the foam member.

Specifically, the sonar 5 is arranged between the pair of first foam members 71 arranged on the left and right with respect to the center axis in the front-rear direction of the watercraft body 10. The watercraft bottom 11A between the pair of first foam members 71 has a curved surface shape that gently bulges downward, and the sonar 5 is arranged at the deepest part 11C thereof. In short, the sonar 5 is arranged between the pair of first foam members 71 and at the deepest part 11C of the convex curved surface of the watercraft bottom 11A. Therefore, the probe surface of the sonar 5 protrudes more downward at a height position with respect to the pair of first foam members 71. Therefore, not only the object detection accuracy immediately below the sonar 5 is not reduced, but also the first foam member 71 does not hinder transmission and reception of ultrasonic waves when the sonar 5 performs searchlight scanning at 360 degrees around the watercraft body 10.

In the positional relationship with respect to the mount surface 11F underpinning the engine support tool 25, the sonar 5 is arranged at the center of the pair of left and right mount surfaces 11F. That is, the sonar 5 is arranged at a position that can be farthest from both the left and right engine support tools 25 supporting the engine 2, which is a vibration generation source. Therefore, in combination with the anti-vibration function of the engine support tool 25, the vibration of the engine 2 itself and the rotational vibration of the impeller 32 are hardly transmitted to the sonar 5.

A guard member 6 is arranged between the engine 2 and the sonar 5. The guard member 6 is formed of a member having rigidity, for example, a bent body of a sheet metal material, and serves to prevent the engine 2 from colliding with the sonar 5. Hereinafter, the guard member 6 will be described.

[Guard Member of Sonar]

Figure 5:
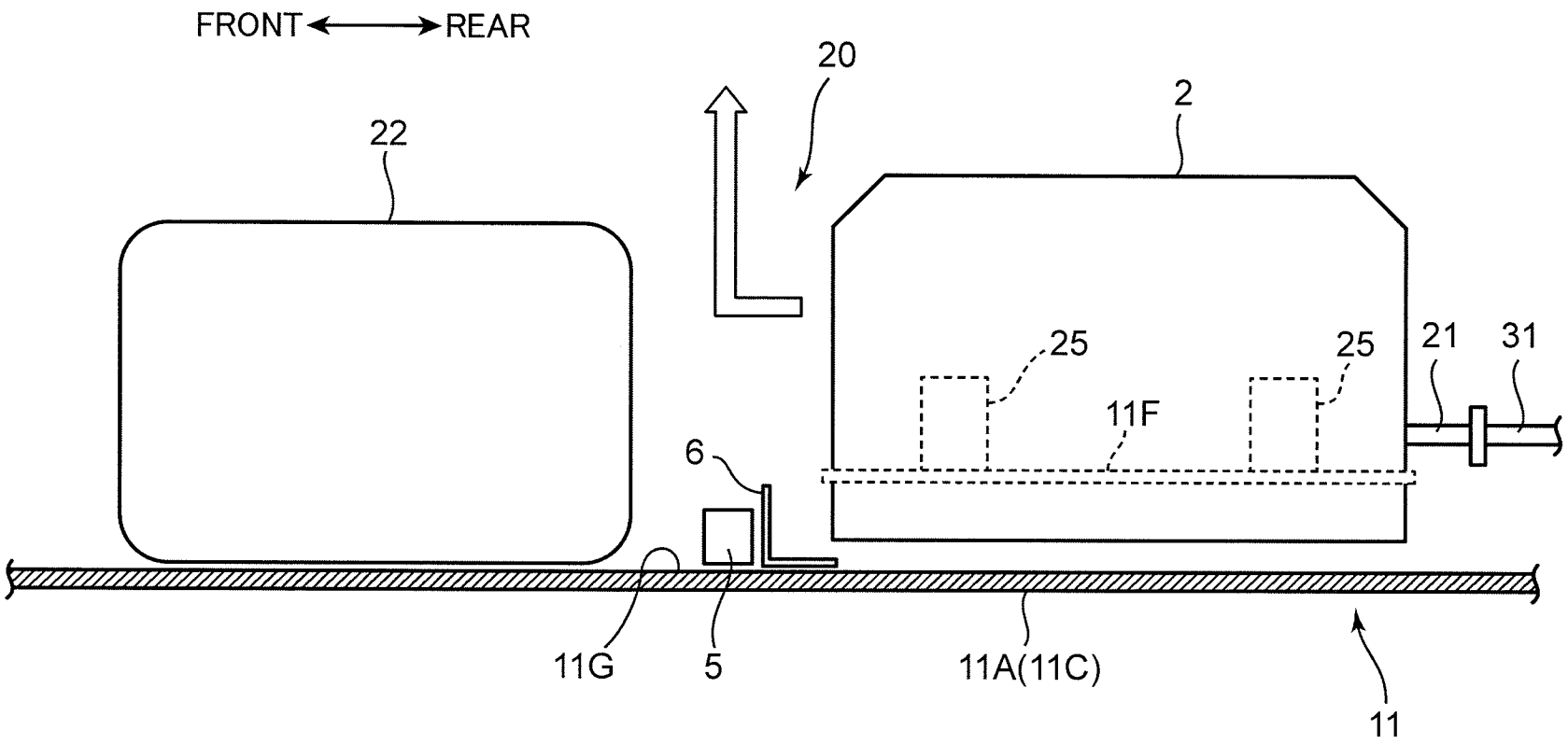
FIG. 5 is a schematic view illustrating arrangement in a watercraft body front-rear direction of a sonar and a guard member.

FIG. 5 is a view schematically illustrating an arrangement relationship of the sonar 5 and the guard member 6 in the front-rear direction of the watercraft body 10. As mentioned earlier, the engine 2 and the fuel tank 22 are arranged side by side in the front-rear direction on the watercraft bottom 11A, and the sonar 5 is arranged on the sonar installation surface 11G positioned between the engine 2 and the fuel tank 22. As seen from FIG. 3, the lower part (oil pan 24) of the engine 2 and the sonar 5 are at a height position overlapping in the front-rear direction. In an actual arrangement, a large space cannot be ensured between the engine 2 and the fuel tank 22, and there may be a tank holder 22A (see FIG. 6) holding the fuel tank 22, so that the space between the front surface of the engine 2 and the sonar 5 has to be narrow.

It is sometimes necessary to remove the engine 2 from the engine room 20 of the watercraft body 10 and return the engine 2 to the engine room 20 after completion of necessary work at the time of maintenance of the engine 2, a response to a failure, or the like. At the time of the removal, it is necessary to once move the engine 2 forward in order to release the claw engagement between the crankshaft 21 and the pump shaft 31, which is the rotation shaft of the impeller 32. That is, when the engine 2 is removed from the engine room 20, the engine 2 cannot be lifted directly upward, and an operation of shifting the engine 2 forward and then lifting the engine 2 is required as indicated by an arrow in the drawing.

During the forward shifting, collision of the engine 2 with the sonar 5 and damage to the sonar 5 due to the collision become a problem. Even if a distance sufficient for the forward shift amount of the engine 2 required to remove the claw engagement is secured between the front surface of the engine 2 and the sonar 5, the contact of the engine 2 with the sonar 5 may occur due to the inertial movement of the engine 2 at the time of disengagement. The guard member 6 is arranged between the engine 2 and the sonar 5 in order to prevent the contact as described above. Even if the engine 2 is excessively moved forward, the engine 2 collides with the guard member 6, so that the sonar 5 is protected. Even when the engine 2 is reinstalled, the guard member 6 higher than the sonar 5 is present, so that it is easy to avoid collision.

Figure 6:
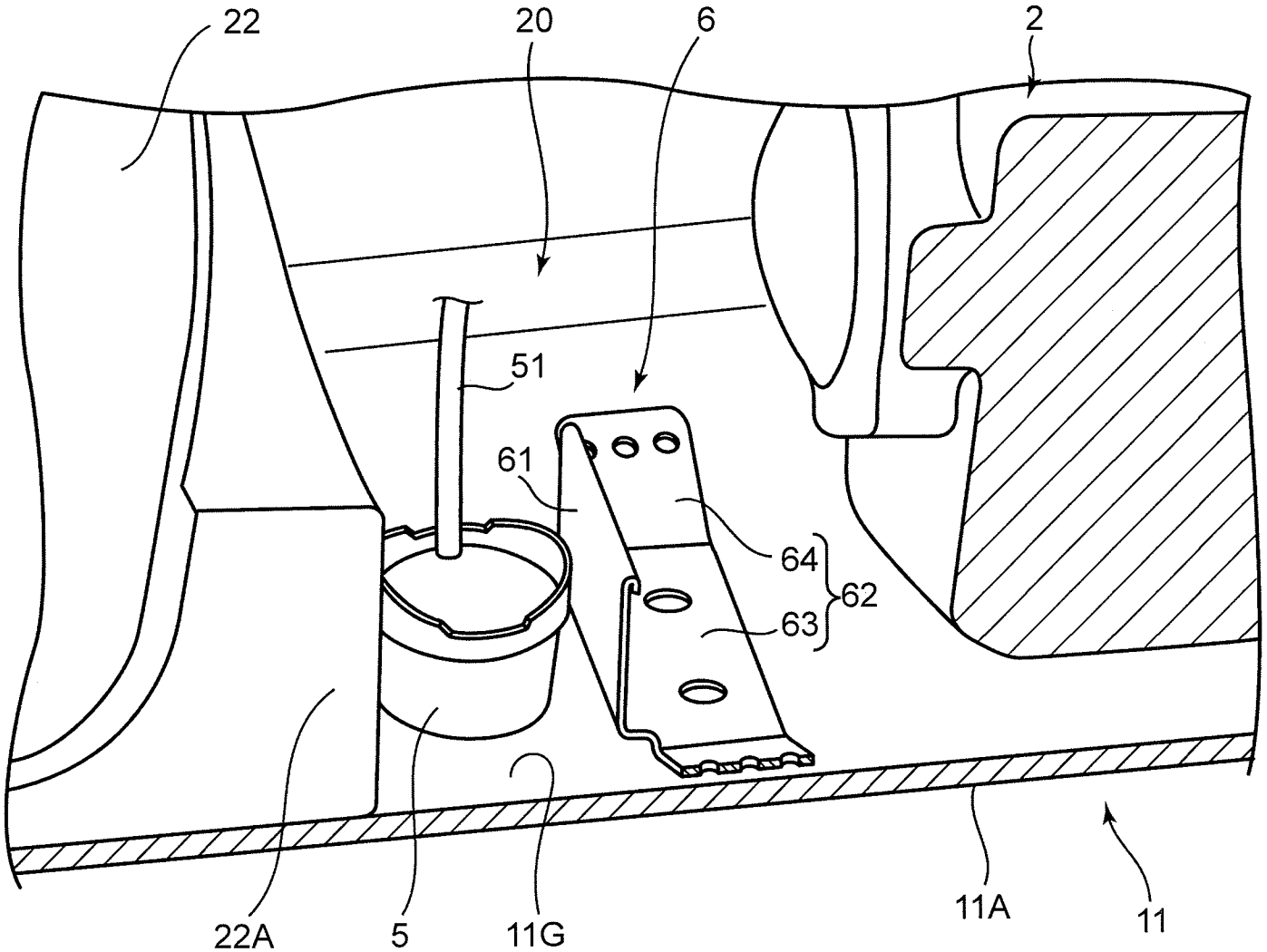
FIG. 6 is a perspective view illustrating the sonar and the guard member.
Figure 7:
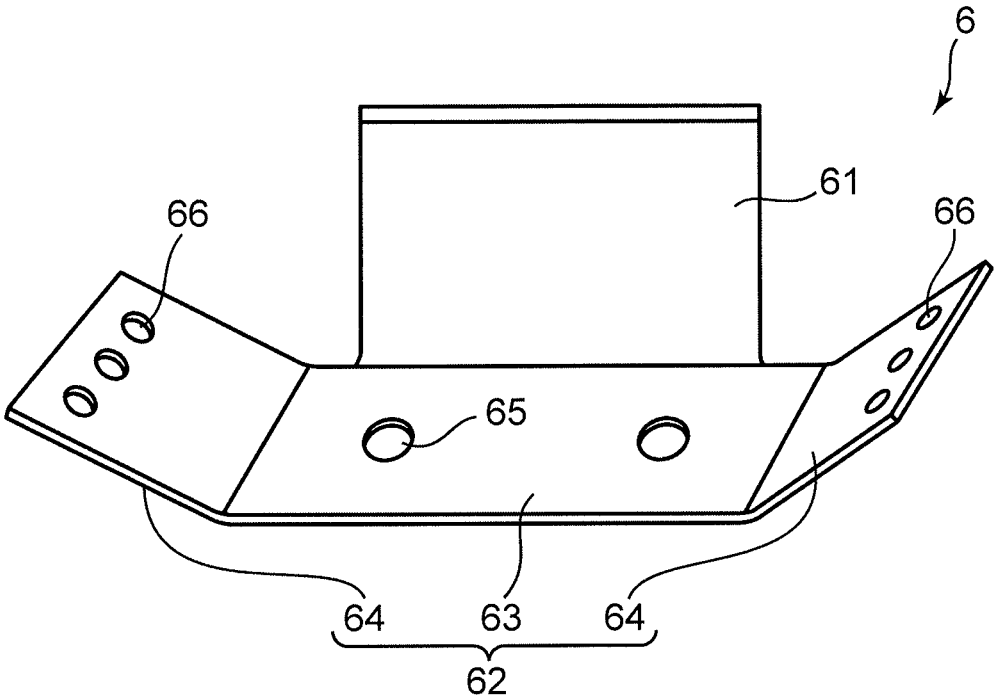
FIG. 7 is a perspective view of the guard member alone.

FIG. 6 is an enlarged partial cross-sectional perspective view illustrating arrangement positions of the sonar 5 and the guard member or guard 6. FIG. 7 is a perspective view of the guard member 6 alone. The guard member 6 includes a guard plate 61 and a fixing plate 62. The guard plate 61 is a flat plate erected at a position actually interfering with the engine 2, and functions to protect the sonar 5. The guard plate 61 extends upward from the watercraft bottom 11A or the vicinity thereof to a position higher than the height of the sonar 5. The guard plate 61 is a part of the guard member or guard 6 which is higher than a height of the sonar 5. The left-right width of the guard plate 61 is wider than the left-right width of the sonar 5.

The fixing plate 62 is a member for fixing the guard plate 61 to the watercraft bottom 11A, and includes a flat plate part 63 and a pair of left and right abutting parts 64. The flat plate part 63 is arranged so as to straddle the convex curved surface of the deepest part 11C in the left-right direction. The fixing plate 62 rises in the vertical direction from the front end edge of the flat plate part 63. A pair of positioning holes 65 are drilled in the flat plate part 63. When the sonar 5 is attached to the sonar installation surface 11G, a positioning jig of the sonar 5 is used. The positioning hole 65 is a hole used to determine a reference position of the jig.

The pair of abutting parts 64 are inclined plates extending from left and right end edges of the flat plate part 63, respectively. The pair of abutting parts 64 are in contact with the inner surface of the watercraft bottoms 11A on the left side and the right side of the deepest part 11C, respectively. A plurality of (three in the present embodiment) adhesive openings 66 used for fixing the guard member 6 to the watercraft bottom 11A are drilled in the abutting part 64. Attachment of the guard member 6 as described above brings the advantages as follows.

Since the guard plate 61 extends to a position higher than the sonar 5, the sonar 5 can be reliably protected when the engine 2 moves in the forward direction or moves from the upper to the down direction, and Since the guard plate 61 is integrally continuously provided with the fixing plate 62 and fixed using the watercraft bottom 11A, the installation structure of the guard plate 61 can be simplified.

Figure 8A:
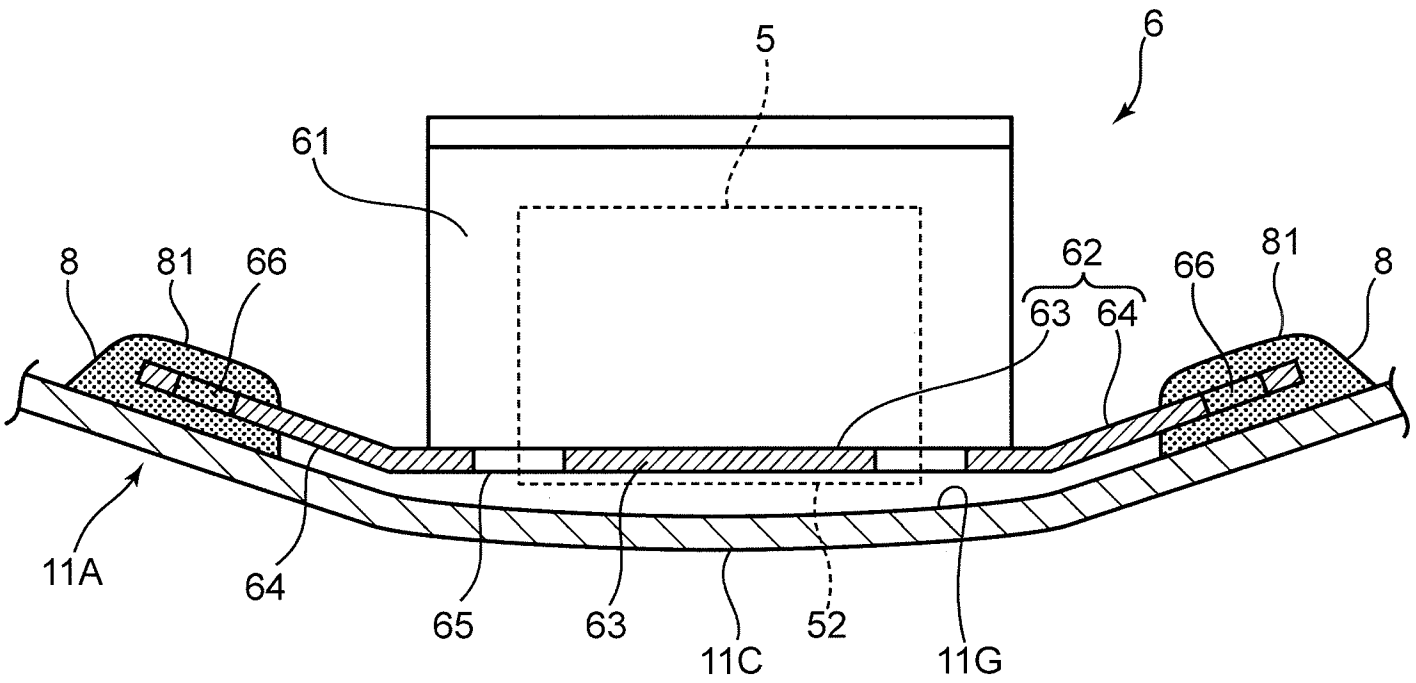
FIG. 8A is a cross-sectional view illustrating an attachment state of the guard member to the watercraft bottom.

FIG. 8A is a cross-sectional view illustrating an attachment state of the guard member 6 to the watercraft bottom 11A. An adhesive is used to attach the guard member 6. This is to avoid the watercraft bottom 11A from being provided with a screw hole or the like that lowers the strength. An adhesive layer 8 is interposed between the abutting part 64 and the watercraft bottom 11A, and the both adhere to each other. As an example of the adhering work, first, the adhesive is applied to the periphery of an adhesive opening 66 in the abutting part 64. For example, work of potting the adhesive to a predetermined position of the watercraft bottom 11A and pressing the abutting part 64 against the adhesive is performed. By this work, the adhesive layer 8 is interposed between the abutting part 64 and the watercraft bottom 11A.

The adhesive layer 8 has a bulging part 81 overflowing from the adhesive opening 66 to the upper surface of the abutting part 64. By pressing the abutting part 64 against the unsolidified adhesive potting, the adhesive passes through the adhesive opening 66 and bulges upward and outward from the upper peripheral edge of the adhesive opening 66. When the adhesive is solidified, the bulging part 81 becomes a portion exhibiting a hook effect, and the abutting part 64 is firmly fixed to the watercraft bottom 11A. Therefore, the guard member 6 can be locked to the watercraft bottom 11A without using a mechanical component such as a screw and without providing the watercraft bottom with a screw hole or the like.

Figure 8B:
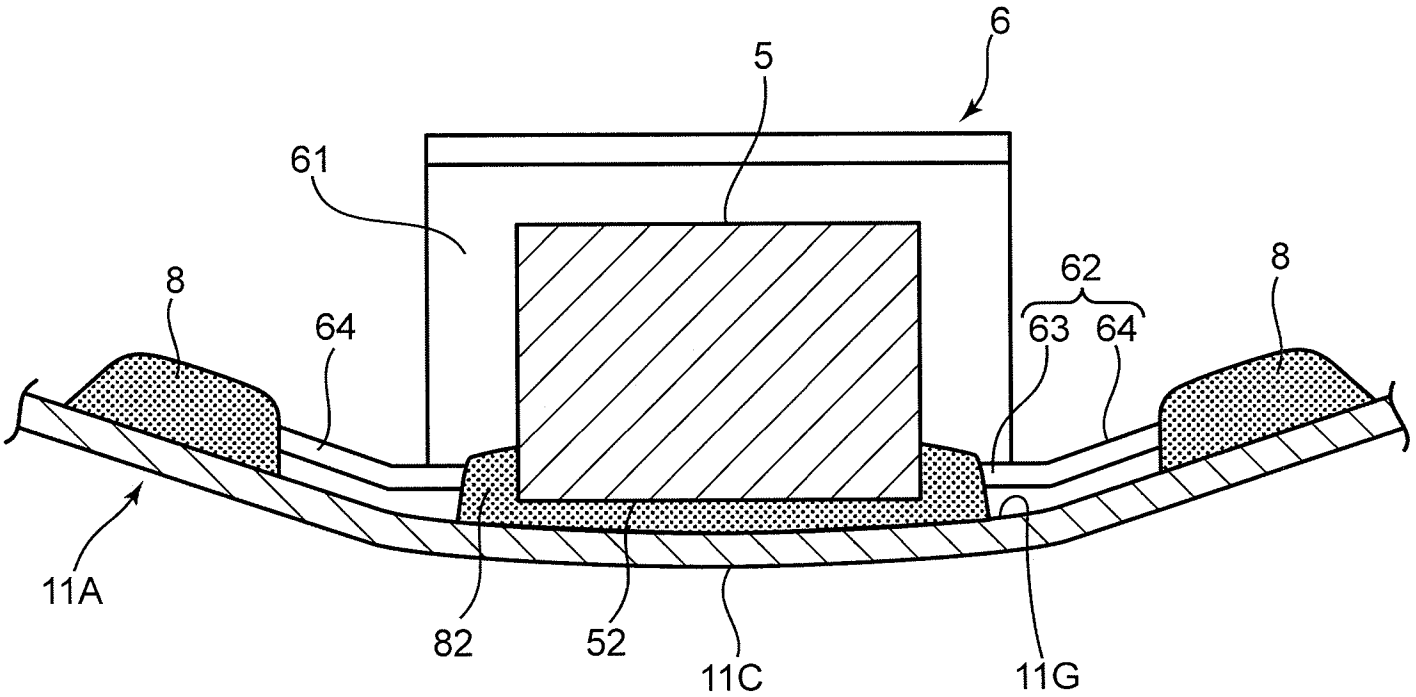
FIG. 8B is a cross-sectional view illustrating an attachment state of the sonar to the watercraft bottom.

FIG. 8B is a view of the guard member or guard 6 and the sonar 5 illustrated in FIG. 8A as viewed from the back surface side, and is a cross-sectional view illustrating an attachment state of the sonar 5 to the watercraft bottom 11A. The sonar 5 is also attached to the watercraft bottom 11A using an adhesive. The probe surface 52 at the lower end of the sonar 5 is flat, whereas the inner surface of the deepest part 11C is a downwardly convex curved surface, so that a void is inevitably generated between the both. The sonar 5 is fixed to the watercraft bottom 11A by a fixing member 82, also referred to as fixing element 82, made of an adhesive that fills the void between the probe surface 52 and the watercraft bottom 11A. FIG. 8A does not illustrate the fixing member 82 for avoiding complication.

According to the attachment aspect of the sonar 5 illustrated in FIG. 8B, the sonar 5 can be directly attached to the watercraft bottom 11A without using a screw or the like. Since a space between the probe surface 52 and the watercraft bottom 11A is filled with the fixing member 82 and air is not interposed between the them, the detection accuracy of the sonar 5 can be improved.

[Modification of Guard Member]

Figure 9:
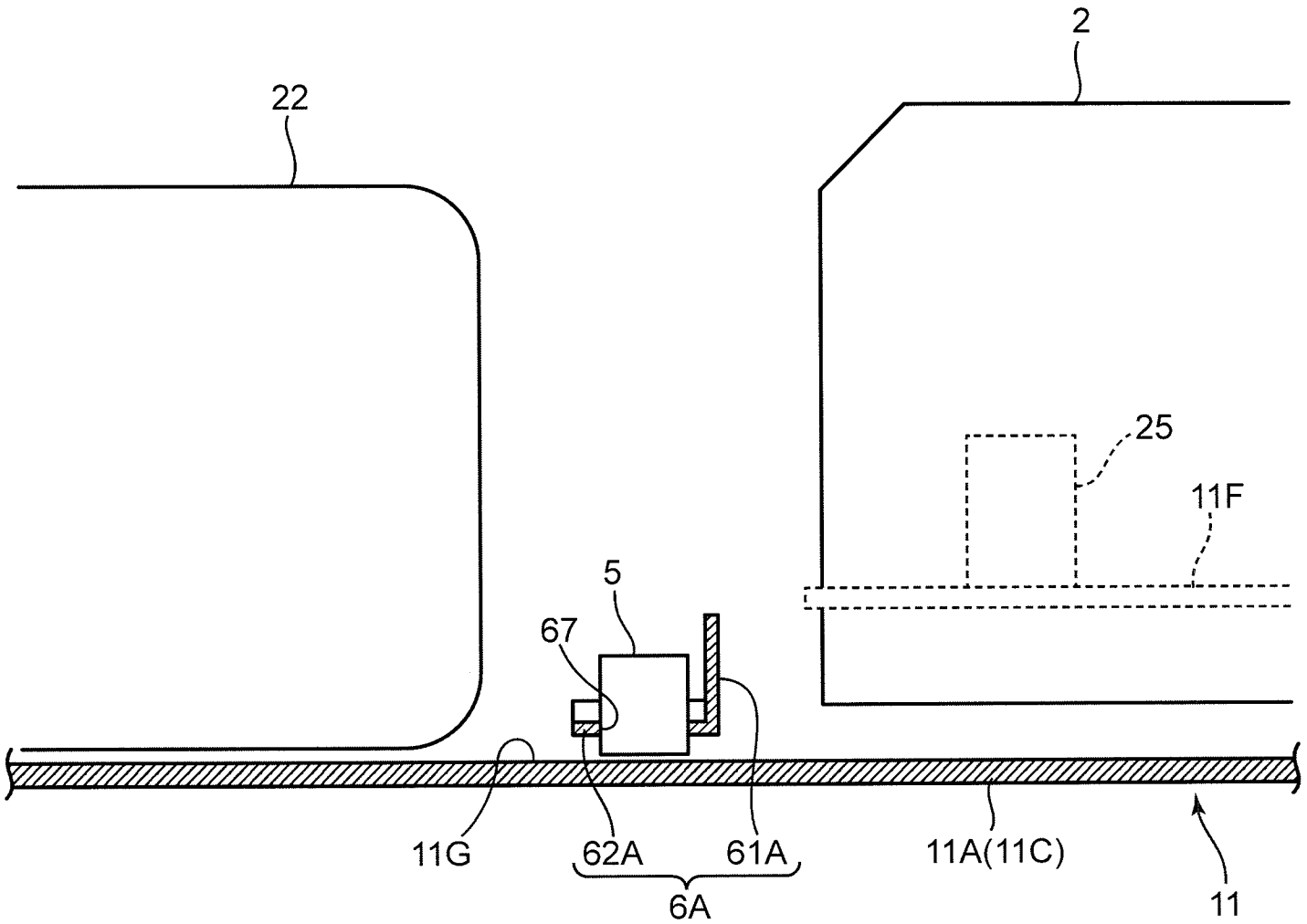
FIG. 9 is a schematic view illustrating an installation situation of a guard member according to a modification.
Figure 10:
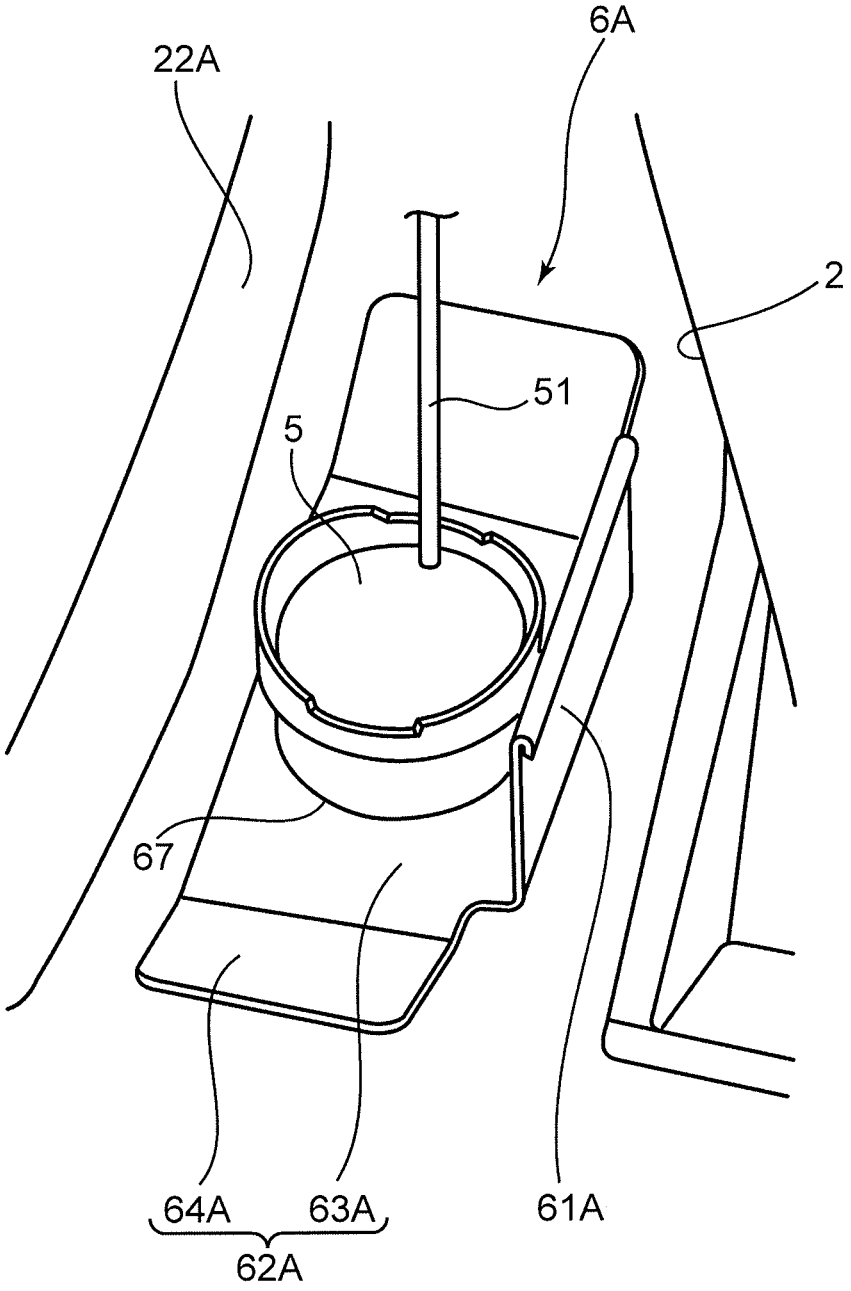
FIG. 10 is a perspective view of the guard member according to the modification.

FIG. 9 is a view schematically illustrating an installation situation of a guard member 6A, also referred to as a guard 6A, according to the modification, and FIG. 10 is a perspective view of the guard member 6A. Similarly to a guard member 6 illustrated in FIG. 7 earlier, the guard member 6A includes a guard plate 61A and a fixing plate 62A, and the fixing plate 62A includes a flat plate part 63A and an abutting part 64A. The arrangement position of the guard member 6A is also between the engine 2 and the fuel tank 22. The difference from the above example is that the flat plate part 62A of the fixing plate 63A serves as a positioning member, also referred to a positioning part 63A, of the sonar 5.

The flat plate part 63A has a fitting opening 67 into which the vicinity of the lower end of the sonar 5 is fitted. When the abutting part 64A is attached to a predetermined position of the watercraft bottom 11A, the fitting opening 67 faces a region of the watercraft bottom 11A corresponding to a predetermined attachment position of the sonar 5. Therefore, after the guard member 6A is attached to the watercraft bottom 11A, the positioning of the sonar 5 is completed only by fitting the sonar 5 into the fitting opening 67. The lower end of the sonar 5 is fixed to the watercraft bottom 11A with an adhesive similarly to the fixing member 82 described above. According to this modification, it is not necessary to use a positioning jig of the sonar 5, and there is an advantage that the sonar 5 can be easily positioned.

Other Embodiments

Although an embodiment of the present disclosure has been described above, the present disclosure is not limited to the above embodiment. For example, the following modified embodiments may be adopted.

In the above embodiment, the engine 2 having an internal combustion engine has been exemplified as a propulsion drive source of the personal watercraft 1, but a propulsion drive source other than the engine 2 may be used. For example, a drive source using an electric motor or a hybrid drive source of an electric motor and an engine may be used.

In the above embodiment, an example in which the personal watercraft 1 is a jet propulsion type watercraft has been described. The personal watercraft 1 according to the present disclosure may be a personal watercraft other than the jet propulsion type. In the above embodiment, the straddle-type personal watercraft 1 has been exemplified. The personal watercraft 1 may be a stand-up type personal watercraft.

SUMMARY OF PRESENT DISCLOSURE

The specific embodiments described above include a disclosure having the following configurations.

A personal watercraft according to a first aspect of the present disclosure includes: a watercraft body having a watercraft bottom; a propulsion device including an engine supported by the watercraft body and a jet pump arranged rearward the engine and driven by the engine; and a sonar arranged on the watercraft bottom forward relative to the engine and capable of transmitting and receiving sound waves.

According to the first aspect, since the sonar is arranged forward the engine, it is possible to make it difficult to be affected by vibration of the jet pump and bubbles generated by the jet pump in the sound wave transmission and reception operation of the sonar. Therefore, the detection accuracy of the sonar can be improved.

A personal watercraft according to a second aspect is the personal watercraft of the first aspect, in which the watercraft bottom has a curved surface shape convex downward in a cross section orthogonal to a center axis in a front-rear direction of the watercraft body, and the sonar is arranged at a deepest part of a convex curved surface of the watercraft bottom.

According to the second aspect, the sonar is arranged at the deepest part of the watercraft bottom having a convex curved surface shape. Therefore, the sound wave transmission and reception point of the sonar can be easily positioned below the water surface at all times during planing, and a detection error of the sonar can be suppressed.

A personal watercraft according to a third aspect is the personal watercraft of the first aspect, in which the sonar is arranged at a center part in a left-right direction of the watercraft bottom.

Also according to the third aspect, it is easy to position the sound wave transmission and reception point of the sonar below the water surface at all times during planing. Therefore, a detection error of the sonar can be suppressed.

A personal watercraft according to a fourth aspect is the personal watercraft of the first to third aspects, in which the sonar is arranged on a flat surface of the watercraft bottom where a radius of curvature becomes 50 meters or more.

A personal watercraft according to a fifth aspect is the personal watercraft of the first to third aspects, in which the watercraft bottom has a quasi-horizontal plane in which an inclination angle with respect to a horizontal plane is 10 degrees or less in a horizontal state where the watercraft body is not inclined in a cross section orthogonal to a center axis in a front-rear direction of the watercraft body, and the sonar is arranged on the quasi-horizontal plane of the watercraft bottom.

According to the fourth and fifth aspects, the sonar can be arranged on a nearly horizontal surface among the surfaces of the watercraft bottom. Therefore, installation work of the sonar on the watercraft bottom becomes easy, and transmission and reception of sound waves can be performed on the flat surface, so that there is an advantage that detection accuracy of the sonar is easily secured.

A personal watercraft according to a sixth aspect is the personal watercraft of the first to fifth aspects, further including a foam member giving buoyancy to the watercraft body, in which the sonar is arranged in a region of the watercraft bottom excluding an arrangement position of the foam member.

A personal watercraft according to a seventh aspect is the personal watercraft of the first to fifth aspects, further including a pair of foam members arranged on left and right with respect to a center axis in a front-rear direction of the watercraft body and giving buoyancy to the watercraft body, in which the sonar is arranged between the pair of foam members.

According to the sixth and seventh aspects, the arrangement of the foam members can give residual buoyancy when the watercraft body overturns. On the other hand, when the sonar is arranged on the foam member, the detection accuracy of the sonar drops by an influence of air in air bubbles contained in the foam member. According to the sixth and seventh aspects, the above problem can be solved.

A personal watercraft according to an eighth aspect is the personal watercraft of the first to fifth aspects, further including a tank arranged on the watercraft bottom at a predetermined interval forward the engine, and storing fuel to be supplied to the engine, in which the sonar is arranged between the tank and the engine.

In general, it is desirable that the engine having a high temperature during operation and the tank storing the combustible fuel are arranged at a regular interval. According to the eighth aspect, the sonar can be arranged using an empty space inevitably generated between the engine and the tank.

A personal watercraft according to a ninth aspect is the personal watercraft of the eighth aspect, further including: a pair of foam members arranged on left and right with respect to a center axis in a front-rear direction of the watercraft body and apply buoyancy to the watercraft body, in which the watercraft bottom has a curved surface shape convex downward in a cross section orthogonal to the center axis of the watercraft body, and the sonar is arranged at a deepest part of a convex curved surface of the watercraft bottom between the pair of foam members.

According to the ninth aspect, there is an advantage that the detection accuracy of the sonar is not lowered by the foam member while using the empty space, and furthermore, the sound wave transmission and reception point of the sonar is easily positioned below the water surface at all times during planing.

A personal watercraft according to a tenth aspect is the personal watercraft of the first to ninth aspects, further including a guard member arranged between the engine and the sonar.

There is a case where work of attaching and detaching the engine to and from the watercraft body is performed at the time of maintenance or response to a failure. According to the tenth aspect, since the guard member or guard is provided, it is possible to prevent contact between the engine and the sonar at the time of attaching and detaching work of the engine to and from the watercraft body.

A personal watercraft according to an eleventh aspect is the personal watercraft of the tenth aspect, in which the guard member includes a guard plate extending upward to a position higher than a height of the sonar from a watercraft bottom or a vicinity of the watercraft bottom and a fixing plate fixing the guard plate to the watercraft bottom. The guard plate 61 of the guard member or guard 6 is a "part higher than a height of the sonar."

According to the eleventh aspect, since the guard plate extends to a position higher than the sonar, the sonar can be reliably protected. Since the guard plate is fixed using the watercraft bottom, the installation structure of the guard plate can be simplified.

A personal watercraft according to a twelfth aspect is the personal watercraft of the eleventh aspect, in which the fixing plate includes an abutting part abutting on the watercraft bottom and an adhesive opening formed in the abutting part, and the personal watercraft further includes an adhesive layer interposed between the abutting part and the watercraft bottom to adhere the abutting part and the watercraft bottom to each other, in which the adhesive layer has a bulging part overflowing from the adhesive opening to an upper surface of the abutting part.

According to the twelfth aspect, by providing the bulging part in which the adhesive overflows from the adhesive opening, the fixing plate can be locked to the watercraft bottom by the hook effect of the bulging part without using a mechanical component and without providing the watercraft bottom with a screw hole or the like.

A personal watercraft according to a thirteenth aspect is the personal watercraft of the eleventh aspect, in which the fixing plate includes an abutting part abutting on the watercraft bottom and a positioning part of the sonar, and the positioning part has a fitting opening into which the sonar is fitted.

According to the thirteenth aspect, the guard member can be caused to also serve as a positioning member or positioning part 63A of the sonar, and the number of components can be reduced.

A personal watercraft according to a fourteenth aspect is the personal watercraft of the first to thirteenth aspects, further including a fixing member, also referred to as a fixing element 82, filling a void between a probe surface of the sonar and the watercraft bottom and fixing the sonar to the watercraft bottom.

According to the fourteenth aspect, since the sonar can be directly attached to the watercraft bottom without using a screw or the like, and the sonar can have a structure in which no air is interposed between the probe surface and the watercraft bottom, the detection accuracy of the sonar can be further improved.

A personal watercraft according to a fifteenth aspect includes: a watercraft body having a watercraft bottom; an impeller that discharges, from a discharge port, water sucked from a water suction port formed in the watercraft bottom; and a sonar arranged on the watercraft bottom relative to the water suction port and capable of transmitting and receiving sound waves.

According to the fifteenth aspect, the sonar is arranged forward relative to the water suction port. Therefore, in the sound wave transmission and reception operation of the sonar, it is possible to make it difficult to be affected by water flow vibration or bubbles generated in the vicinity of the water suction port or the discharge port by the operation of the impeller. Therefore, the detection accuracy of the sonar can be improved.

What is claimed is:

1. A personal watercraft comprising:

a watercraft body having a watercraft bottom;

a propulsion device including an engine supported by the watercraft body and a jet pump rearward the engine and driven by the engine; and a sonar on the watercraft bottom forward relative to the engine and capable of transmitting and receiving sound waves, wherein:

the propulsion device includes an impeller to generate a water flow and an impeller passage in which the impeller is disposed, the engine is forward the impeller passage, and the sonar is forward the engine.

2. The personal watercraft of claim 1, wherein:

the watercraft bottom has a curved surface shape convex downward in a cross section orthogonal to a center axis in a front-rear direction of the watercraft body, and the sonar is at a deepest part of a convex curved surface of the watercraft bottom.

3. The personal watercraft of claim 1, wherein:

the sonar is at a center part in a left-right direction of the watercraft bottom.

4. The personal watercraft of claim 1, wherein:

the sonar is on a flat surface of the watercraft bottom where a radius of curvature becomes 50 meters or more.

5. The personal watercraft of claim 1, wherein:

the watercraft bottom has a quasi-horizontal plane in which an inclination angle with respect to a horizontal plane is 10 degrees or less in a horizontal state where the watercraft body is not inclined in a cross section orthogonal to a center axis in a front-rear direction of the watercraft body, and the sonar is on the quasi-horizontal plane of the watercraft bottom.

6. The personal watercraft of claim 1, further comprising:

buoyant foam within the watercraft body, wherein the sonar is in a region of the watercraft bottom excluding a position of the buoyant foam.

7. The personal watercraft of claim 1, further comprising:

a pair of buoyant foam structures within the watercraft body on left and right with respect to a center axis in a front-rear direction of the watercraft body, wherein the sonar is between the pair of buoyant foam structures.

8. The personal watercraft of claim 1, further comprising:

a tank on the watercraft bottom at a predetermined interval forward of the engine, and storing fuel to be supplied to the engine, wherein the sonar is between the tank and the engine.

9. The personal watercraft of claim 8, further comprising:

a pair of buoyant foam structures within the watercraft body on left and right with respect to a center axis in a front-rear direction of the watercraft body, wherein:

the watercraft bottom has a curved surface shape convex downward in a cross section orthogonal to the center axis of the watercraft body, and the sonar is at a deepest part of a convex curved surface of the watercraft bottom between the pair of buoyant foam structures.

10. The personal watercraft of claim 1, further comprising:

a guard between the engine and the sonar.

11. The personal watercraft of claim 10, wherein the guard includes:

a guard plate extending upward to a position higher than a height of the sonar from the watercraft bottom or a vicinity of the watercraft bottom, and a fixing plate fixing the guard plate to the watercraft bottom.

12. The personal watercraft of claim 11, wherein:

the fixing plate includes an abutting part abutting on the watercraft bottom and an adhesive opening in the abutting part, and the personal watercraft further comprises:

an adhesive layer interposed between the abutting part and the watercraft bottom to adhere the abutting part and the watercraft bottom to each other, wherein the adhesive layer has a bulging part overflowing from the adhesive opening to an upper surface of the abutting part.

13. The personal watercraft of claim 11, wherein:

the fixing plate includes an abutting part abutting on the watercraft bottom and a positioning part of the sonar, and the positioning part includes a fitting opening into which the sonar is fitted.

14. The personal watercraft of claim 1, further comprising:

a fixing element filling a void between a probe surface of the sonar and the watercraft bottom and fixing the sonar to the watercraft bottom.

15. A personal watercraft comprising:

a watercraft body having a watercraft bottom;

an engine supported by the watercraft body;

an impeller passage including a water suction port formed in the watercraft bottom and a discharge port that discharges water sucked from the water suction port, and an impeller configured to generate water flow being arranged in the impeller passage; and a sonar on the watercraft bottom relative to the water suction port and capable of transmitting and receiving sound waves, wherein:

the engine is forward the impeller passage, and the sonar is forward the engine.

16. The personal watercraft of claim 1, wherein:

the impeller passage includes a water suction port in the watercraft bottom, and the engine is forward the water suction port.

17. The personal watercraft of claim 15, wherein:

the engine is forward of the water suction port.

18. A personal watercraft comprising:

a watercraft body having a watercraft bottom;

a propulsion device including an engine supported by the watercraft body and a jet pump rearward the engine and driven by the engine;

a sonar on the watercraft bottom forward relative to the engine and to transmit and receive sound waves; and a guard that protrudes upwardly from the watercraft bottom between the engine and the sonar and has a part higher than a height of the sonar.

* * * * *